US006817134B2

(12) United States Patent
Newman

(10) Patent No.: US 6,817,134 B2
(45) Date of Patent: Nov. 16, 2004

(54) DEVICE FOR LOADING BULLETS INTO FIREARM MAGAZINES

(75) Inventor: Philip Newman, Boca Raton, FL (US)

(73) Assignee: Rainbow Precision Manufacturing Corp., Palm Beach Gardens, FL (US)

( * ) Notice: Subject to any disclaimer, the term of this patent is extended or adjusted under 35 U.S.C. 154(b) by 0 days.

(21) Appl. No.: 10/439,419

(22) Filed: May 15, 2003

(65) Prior Publication Data

US 2004/0159036 A1 Aug. 19, 2004

Related U.S. Application Data

(63) Continuation-in-part of application No. 10/368,296, filed on Feb. 13, 2003.

(51) Int. Cl.[7] ..... F41A 9/83
(52) U.S. Cl. ..... 42/87; 42/90
(58) Field of Search ..... 42/87, 88, 90

(56) References Cited

U.S. PATENT DOCUMENTS 5,377,436 A * 1/1995 Switzer ..... 42/87

FOREIGN PATENT DOCUMENTS

DE 304379 * 10/1917 ..... 42/87
FR 693.501 * 11/1930 ..... 42/90
GB 555367 * 8/1943 ..... 42/87

* cited by examiner

*Primary Examiner*—Stephen M. Johnson
(74) *Attorney, Agent, or Firm*—Robert M. Downey, P.A.

(57) ABSTRACT

A rapid action bullet reloading device for use in conjunction with any firearm utilizing a removable magazine is operable by either hand of the user with minimal effort. The device includes a sleeve, defining a main body, a lever hinged to the sleeve and a cam member operatively engaged with the lever. The sleeve is structured and disposed to receive the magazine in a releasably locked and registered position for the bullet reloading operation. The device is operated by squeezing the lever towards the sleeve body with one hand which rotates the cam member about a cam axis in a highly leveraged action. Rotation of the cam causes an integral finger extending from the cam member to engage and depress a properly positioned bullet into the magazine. A spring urges the cam member back to the relaxed position upon each release of the lever, whereupon a next successive bullet can be placed in registered position for loading. In several embodiments, a hood is hingedly fitted to the top end of the sleeve body and includes an axial bore, defining a loading chamber, through which the bullets are inserted, using the other hand to guide each bullet into the registered loading position.

27 Claims, 9 Drawing Sheets

DEVICE FOR LOADING BULLETS INTO FIREARM MAGAZINES

This application is a continuation-in-part of application Ser. No. 10/368,296, filed Feb. 13, 2003.

BACKGROUND OF THE INVENTION

1. Field of the Invention

This invention relates to a bullet loader and, more particularly, to a device for reloading bullets into the magazine or clip of a firearm.

2. Discussion of the Related Art

Most semi-automatic and automatic weapons are provided with a removable magazine for holding a large number of bullets or rounds of ammunition. Additionally, some handguns, such as 9 mm pistols, are structured to receive a bullet-holding magazine, often referred to as a "clip." Regardless of the particular type, make or model of the weapon, virtually all magazines are structured to function according to the same general principal of operation. Specifically, the magazine includes a generally elongate, vertical chamber with partially open ejection end at the top. Bullets are loaded, in sequence, into the magazine and against the compression force exerted by a compression spring, so that a stacked arrangement of bullets within the magazine is urged upwardly towards the top ejection end. When the loaded magazine is inserted into the firearm, the force of the compression spring causes the bullets to be individually fed, one at a time in succession, into the gun's firing chamber.

The use of a magazine in a firearm provides the convenience of holding a large number of bullets in position for loading in successive order into the firing chamber, thereby allowing for rapid fire of some or all of the loaded bullets. Once the bullets are expended, the empty magazine can be quickly removed and a new fully loaded magazine can be quickly inserted into the firearm to resume firing.

The use of magazines is a convenient and effective method of feeding bullets, in rapid succession, into a weapon's firing chamber. However, reloading bullets into the spent magazines is known to be problematic. Specifically, the structural design of the magazine requires each bullet to be individually loaded through the top ejection end and downwardly against the force of the compression spring in order to captivate the bullet within the magazine. As each bullet is loaded, in sequence, the compression spring becomes progressively compressed until the magazine is fully loaded with bullets Naturally, the resistance of the compression spring against the downward force of loading the bullets into the magazine becomes greater with each successive bullet loaded into the magazine.

For many years, bullets have been loaded into the magazines of firearms by hand, using the fingers to force each bullet downwardly against the force of the compression spring and into captured arrangement within the magazine. This process is time consuming, awkward, and often frustrating, particularly when the resistance of the compression spring begins to increase. And, in view of the fact that the entire load of bullets in the magazine can be expended in a matter of seconds, particularly in an automatic weapon, the task of reloading several empty magazines can be daunting.

In the past, others have proposed various devices for reloading bullets or "cartridges" into the clip of a handgun. And, while some of these devices have provided some improvement to the traditional reloading method of using ones fingers to force the bullets into the clip, they provide minimal mechanical advantage over the compressive force exerted by the spring in the clip. Moreover, the reloading devices known in the prior art require use of the thumb for operation. It has been found that successive operation of these devices, particularly when loading several clips, results in fatigue and possible strain or injury to the thumb and hand muscles. An example of a clip reloading device in the prior art which uses a thumb lever is shown in the U.S. patents to Switzer, Nos. 5,377,436 and 5,249,386. Additional examples of reloading devices for handgun clips are shown in the U.S. patents to Holmes, No. 4,829,693; Upchurch, No. 4,993,180; and Origoni, No. 5,355,606. All of these devices are limited to use with handgun clips.

In view of the numerous problems associated with loading bullets into the magazines of automatic and semi-automatic weapons, as well as handguns, and the limitations of the loading devices in the present state of the art, there remains an urgent need for a rapid action bullet reloading device for use in conjunction with any magazine style of all types of firearms and which is operable by either hand of the user with minimal effort. Moreover, there remains a need for a bullet loading device which provides a sufficient mechanical advantage to overcome the counter-acting force of the compression spring within a magazine so that each bullet, from the first to the last, can be loaded into the magazine with the same minimal effort. Additionally, there remains a need for a bullet reloading device which is structured to properly position each bullet into registered alignment with the top of the magazine and a cam depression finger of the device, thereby allowing the user to easily operate the device with either hand, while allowing the user to place bullets into the device for loading into the magazine using the other hand.

SUMMARY OF THE INVENTION

The present invention is directed to a rapid action bullet reloading device for use in conjunction with any firearm utilizing a removable magazine is operable by either hand of the user with minimal effort. The device includes a sleeve, defining a main body, a lever hinged to the sleeve and a cam member operatively engaged with the lever. The sleeve is structured and disposed to receive the magazine in a releasably locked and registered position for the bullet reloading operation. The device is operated by squeezing the lever towards the sleeve body with one hand which rotates the cam member about a cam axis in a highly leveraged action. Rotation of the cam causes an integral finger extending from the cam member to engage and depress a properly positioned bullet into the magazine. A spring urges the cam member back to the relaxed position upon each release of the lever, whereupon a next successive bullet can be placed in registered position for loading. In a preferred embodiment, the top end of the lever and cam member are each provided with intermeshing teeth to provide positive traction with minimal friction, thereby reducing wear and slippage between the lever and cam. In several embodiments, a hood is hingedly fitted to the top end of the sleeve body and includes an axial bore, defining a loading chamber through which the bullets are inserted, using the other hand, for individual positioning in registered alignment for loading into the magazine.

OBJECTS AND ADVANTAGES OF THE INVENTION

Considering the foregoing, it is a primary object of the present invention to provide a rapid action bullet loading device for use in conjunction with any firearm utilizing a removably magazine, and wherein the device is easily operable by a single hand of the user, either the left hand or the right hand, with minimal effort to effectively load bullets into the magazine.

It is still a further object of the present invention to provide a bullet loading device which provides a highly leveraged action to depress each bullet into the magazine, with minimal effort and using only one hand.

It is still a further object of the present invention to provide a bullet loading device which provides for a highly leveraged action to depress bullets into a magazine, and wherein the leveraged loading mechanism provides sufficient mechanical advantage to overcome the counteracting force of the compression spring within the magazine so that each bullet, from the first loaded bullet to the last loaded bullet, can be loaded into the magazine with the same minimal effort.

It is still a further object of the present invention to provide a bullet loading device which employs a cam action to provide substantial mechanical advantage when loading bullets into a magazine, thereby allowing for ease of operation, with a single hand, while preventing fatigue during extended loading operations.

It is yet a further object of the present invention to provide a bullet loading device which provides a loading chamber for guiding each bullet into registered loading position, thereby allowing bullets to be loaded even in dark conditions.

It is still a further object of the present invention to provide a bullet loading device which allows for operation with a single hand while allowing the other hand to feed bullets into a registered loading position with each operation of the device.

It is yet a further object of the present invention to provide a bullet loading device which is adapted for use with any and all makes, models and types of handgun magazines.

It is still a further object of the present invention to provide a bullet loading device which can be manufactured in various models to accommodate all types of firearm magazines, including magazines for automatic weapons, semi-automatic weapons and handguns.

It is still a further object of the present invention to provide a rapid action bullet loading device, as set forth above, and wherein the leveraged cam action is adjustable to accommodate for different types and models of firearm magazines having varying compression spring tensions.

It is still a further object of the present invention to provide a rapid action bullet loading device wherein the mechanical leverage for depressing bullets into the magazine, against the compression spring, can be adjustably varied by changing the configuration of the cam and the throw of the cam finger.

It is still a further object of the present invention to provide a rapid action bullet loading device which employs a cam action to provide substantial mechanical advantage when loading bullets into a magazine, and wherein a pivoting lever and cam member are each provided with intermeshing gripping teeth, thereby providing a positive traction driving movement of the cam member upon squeezing the lever with minimal friction.

It is still a further object of the present invention to provide a rapid action bullet loading device, as set forth above, wherein the intermeshing gripping teeth on the lever and cam are structured to provide a positive drive between the lever and cam with minimal friction, thereby eliminating wear and increasing longevity of the device.

It is still a further object of the present invention to provide a device for loading bullets into a handgun which provides all of the objects and advantages set forth above, and which can be manufactured of a variety of materials, including ferrous, non-ferrous and/or plastic compositions.

These and other objects of the present invention will be more readily apparent with reference to the detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
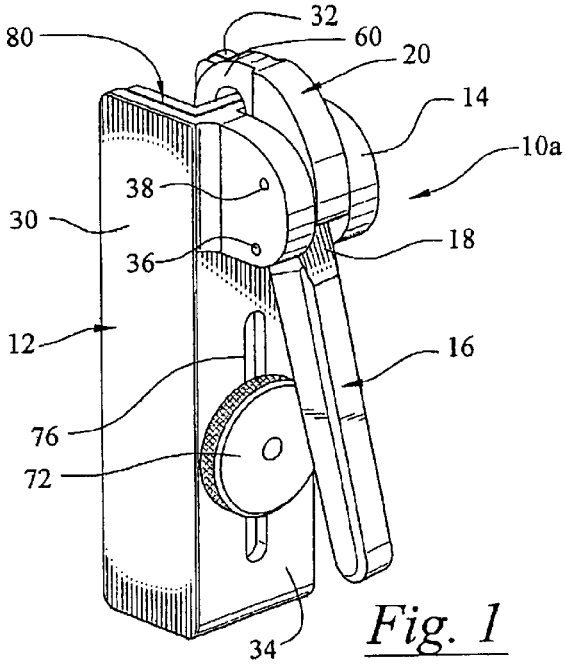
FIG. 1 is a rear perspective view of a bullet loading device for use in conjunction with a magazine or clip of a handgun, in accordance with one preferred embodiment of the present invention.
Figure 2A:
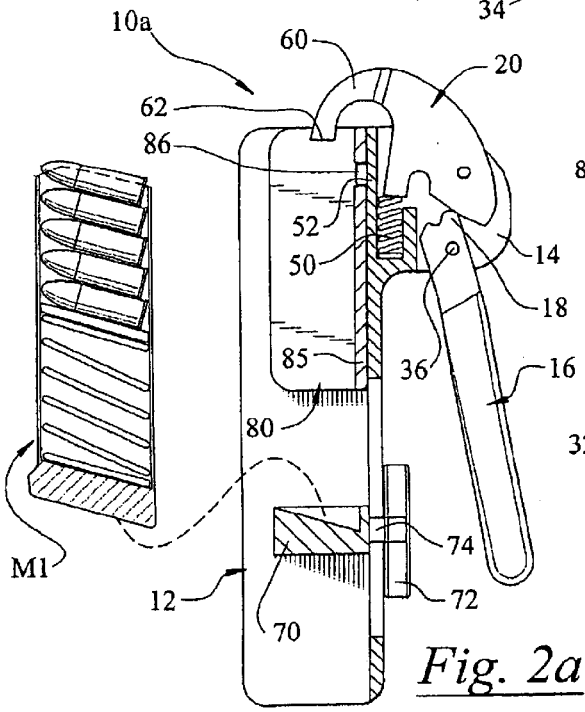
FIG. 2*a* is a side elevational view, in partial cross-section, illustrating the bullet loading device of FIG. 1 with a handgun magazine being inserted, as indicated by the dotted line, for seated position within the sleeve of the device and in registered alignment with a pivoting cam member.
Figure 2B:
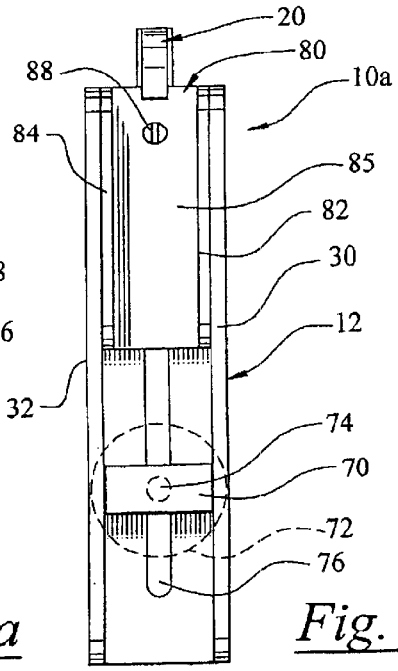
FIG. 2*b* is a front elevational view of the bullet loading device of FIG. 1.

Referring to the several views of the drawings, the bullet loading device of the present invention is shown in accordance with several embodiments thereof.

Referring initially to FIGS. 1–4*b*, a first preferred embodiment of the bullet loading device is shown and is generally indicated as 10*a*. Other preferred embodiments of the bullet loading device are shown throughout the drawings, including the bullet loading device 10*b* in FIGS. 5–8, the bullet loading device 10*c* in FIGS. 9*a* and 9*b*, and the bullet loading device 10*d* in FIGS. 10*a*–11.

In each embodiment shown throughout the drawings, the device 10*a*–10*d* includes a sleeve 12 defining a main body, a lever 16 hinged to a back portion of the main body 14 and a cam member 20 pivotally fitted to the sleeve body 12 and in operative engagement with a top end 18 of the lever 16. The sleeve body 12 includes opposing side walls 30, 32 and rear wall 34. In each of the various embodiments, as shown throughout the drawings, the configuration of the sleeve body 12, including the shape of the side walls 30, 32 and the space between the side walls 30, 32 is varied to accommodate magazines of different types of firearms, as well as various makes and models of magazines for the same type of firearm.

In each embodiment, shown throughout the drawings, the device is structured and disposed to apply a downward depressing force against a bullet B in order to force the bullet B down against a force exerted by a compression spring within the firearm magazine in order to load the bullet B into the magazine. To accomplish this, in a highly leveraged action, the lever 16 and cam member 20 are pivotally mounted to the rear portion 14 of the sleeve body 12 using pivot pins 36, 38, respectively. The pivot pins 36, 38 may be any of a variety of materials such as stainless steel roll pins, aluminum, or a plastic or nylon composition. The lever 16 and cam member 20 are specifically positioned and arranged in operative engagement to provide the desired mechanical advantage.

In several embodiments of the invention, a cam surface 40 on the cam member 20 maintains operative engagement against a top distal end 42 on the top end 18 of the lever 16. The top distal end 42 may be rounded to provide a smooth engagement with the cam surface 40 upon pivoting movement of the lever 16 and cam member 20. Upon squeezing lever 16, with the use of one hand, the top end of the lever 16 rotates about pivot pin 36, causing the top distal end 42 of the lever to forcibly engage the cam surface 40 on the cam member 20. This results in forced rotation of the cam member 20 about pivot pin 38.

Figure 3A:
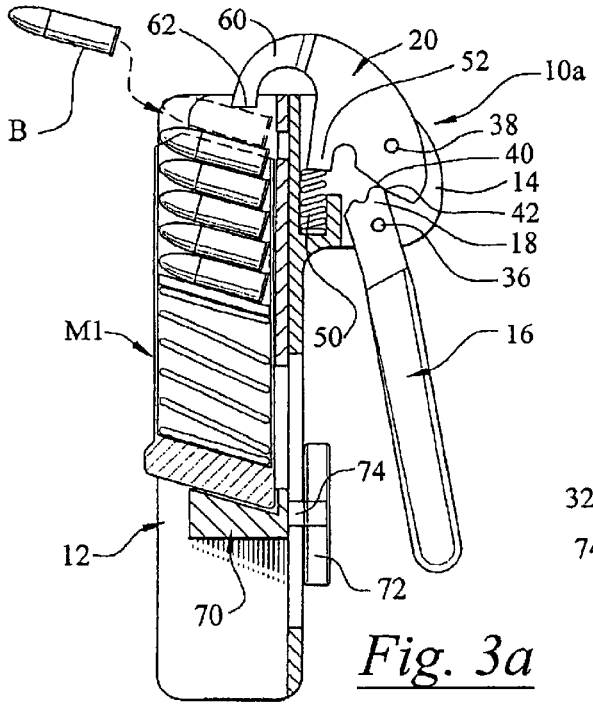
FIG. 3*a* is a side elevational view, in partial section, illustrating operation of the bullet loading device of FIG. 1 to load bullets into the magazine of a handgun.
Figure 3B:
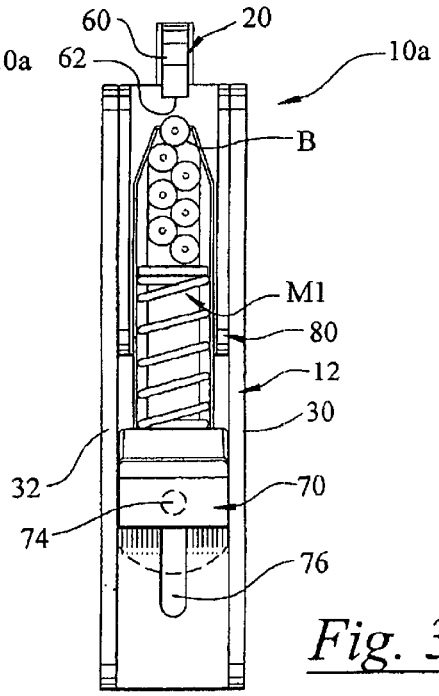
FIG. 3*b* is a front elevational view of the bullet loading device and magazine of FIG. 3*a;*
Figure 4A:
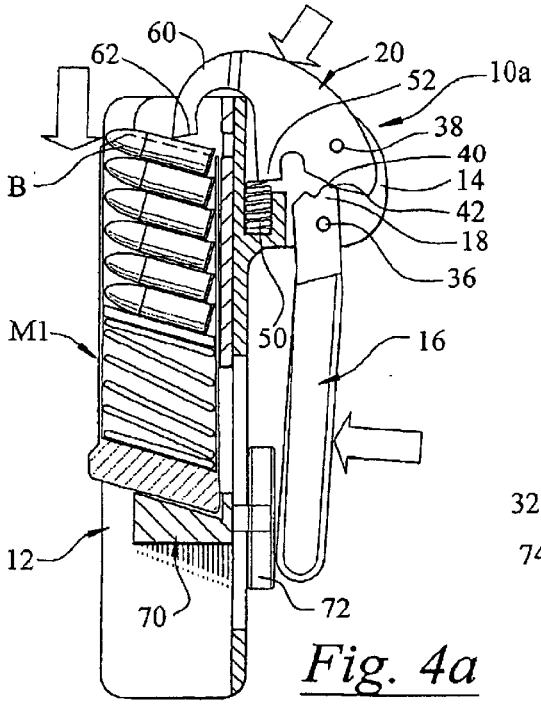
FIG. 4*a* is a side elevational view, in partial section, illustrating operation of a cam action loading mechanism, wherein a lever of the device is squeezed towards the sleeve of the device, as shown by the arrow, to urge a cam member about a pivot axis and an integral cam finger downwardly against the top positioned bullet, as indicated by the arrows, resulting in the bullet being forced downwardly against the compression spring of the magazine and into captivated relation within the magazine.
Figure 4B:
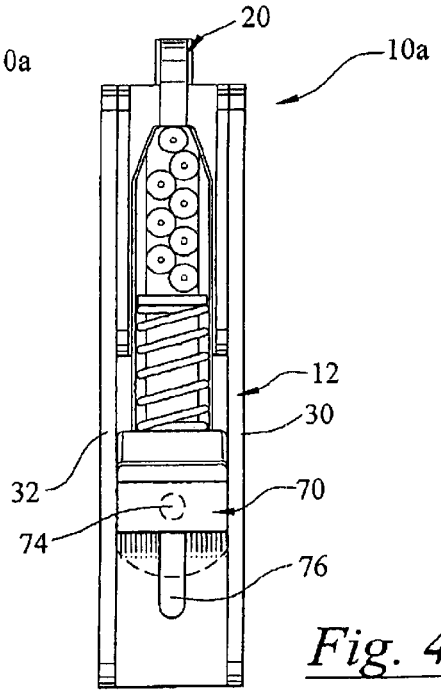
FIG. 4*b* is a front elevational view of the bullet loading device and magazine of FIG. 4*a;*
Figure 5:
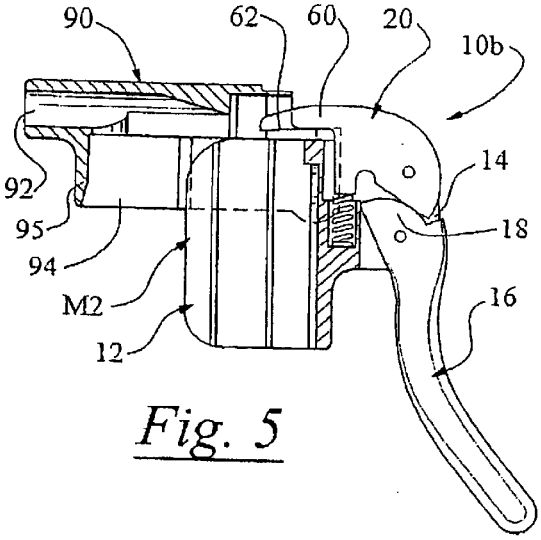
FIG. 5 is a side elevational view, in partial section, illustrating a bullet loading device with a pivoting hood to facilitate insertion and registered alignment of bullets with the device for loading into the magazine, and wherein the bullet loading device is particularly adapted for use with an M-16 rifle.
Figure 6:
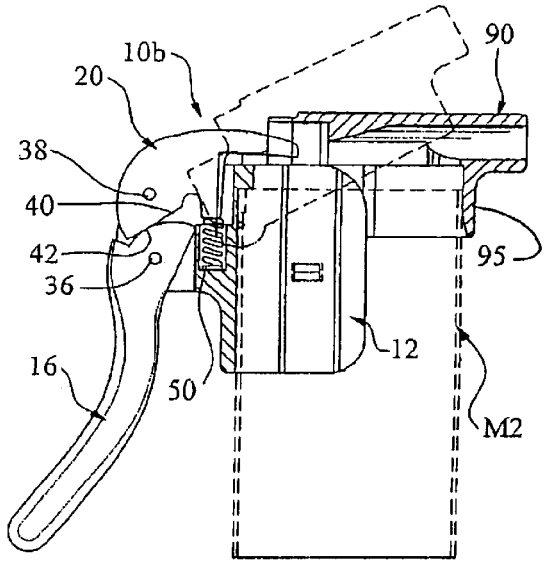
FIG. 6 is a side elevational view of the device of FIG. 5, shown in partial section, illustrating pivoting movement of the hood and positioning of the device on an M-16 magazine, as illustrated in phantom lines.
Figure 7A:
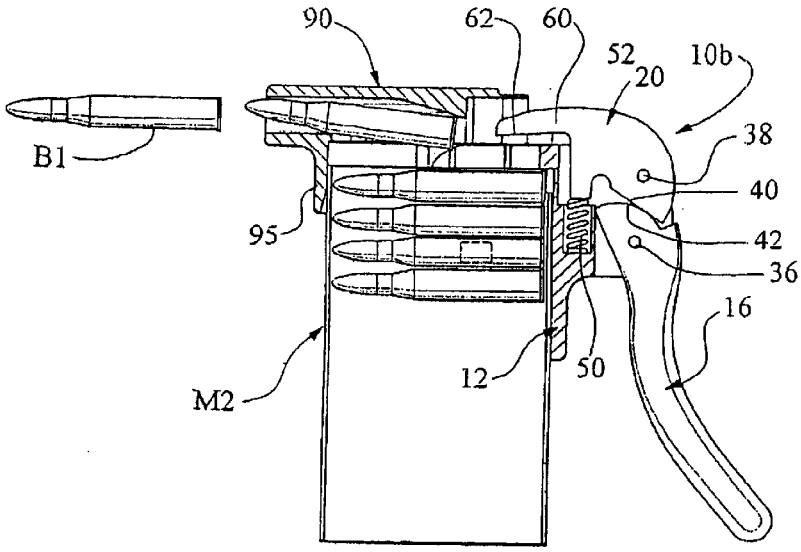
FIGS. 7*a*–7*c* show the bullet loading device of FIG. 5, in partial section, operatively attached to an M-16 magazine, illustrating a sequence of operation to load bullets into the magazine.
Figure 7B:
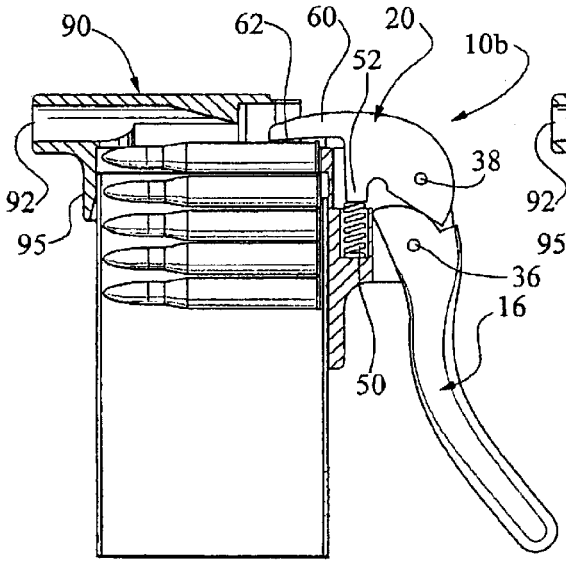
Figure 7C:
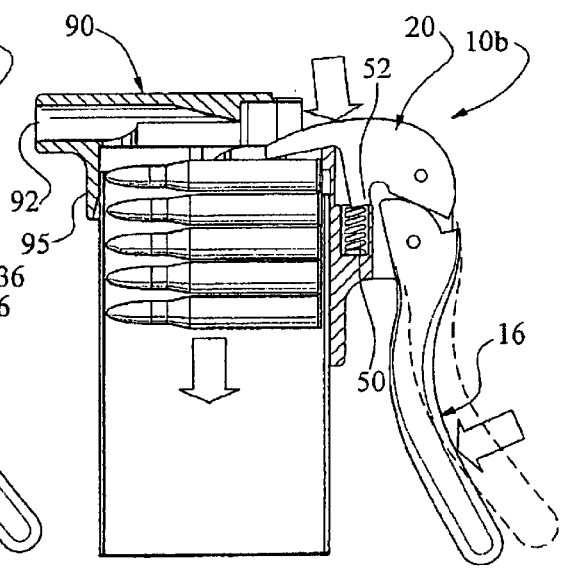
Figure 7D:
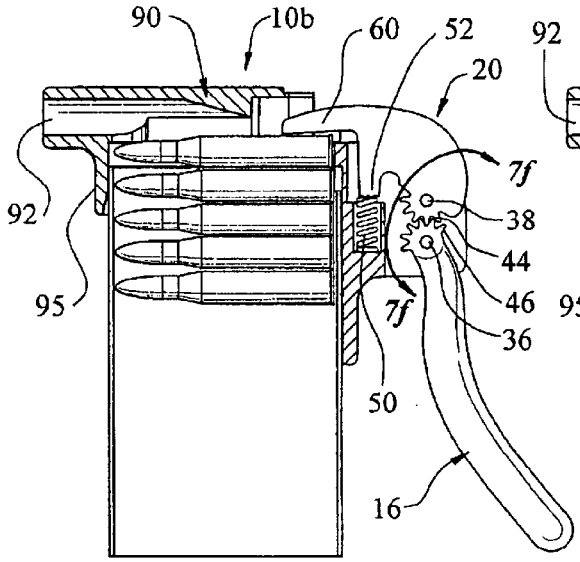
FIGS. 7*d*–7*e* show a side elevational view, in partial section, illustrating a sequence of operation to load bullets into a magazine, such as an M-16 magazine, and wherein the pivoting lever and cam member are provided with intermeshing gripping teeth for positive driven movement of the cam member, with reduced friction, upon squeezing the lever, in accordance with a preferred embodiment of the present invention.
Figure 7E:
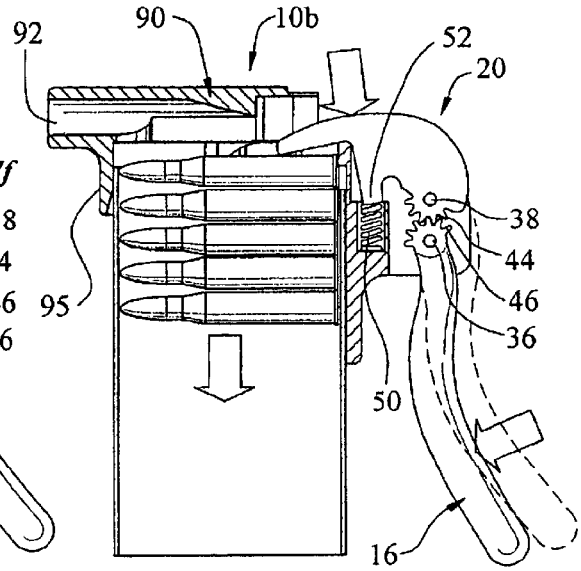
Figure 7F:
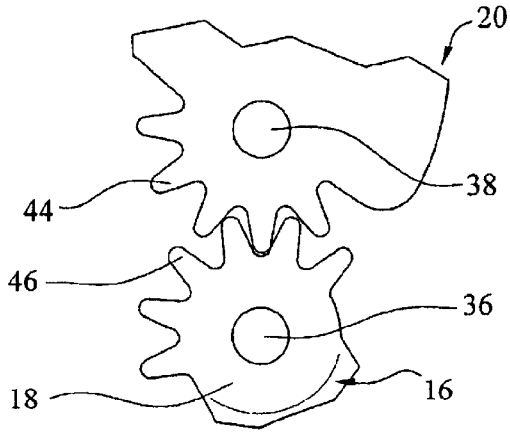
FIG. 7*f* is an isolated view taken from the area indicated as 7*f* in FIG. 7*d*, illustrating the intermeshing arrangement of the gripping teeth on the top end of the lever and on the lower portion of the cam member, in accordance with a preferred embodiment of the present invention.
Figure 8:
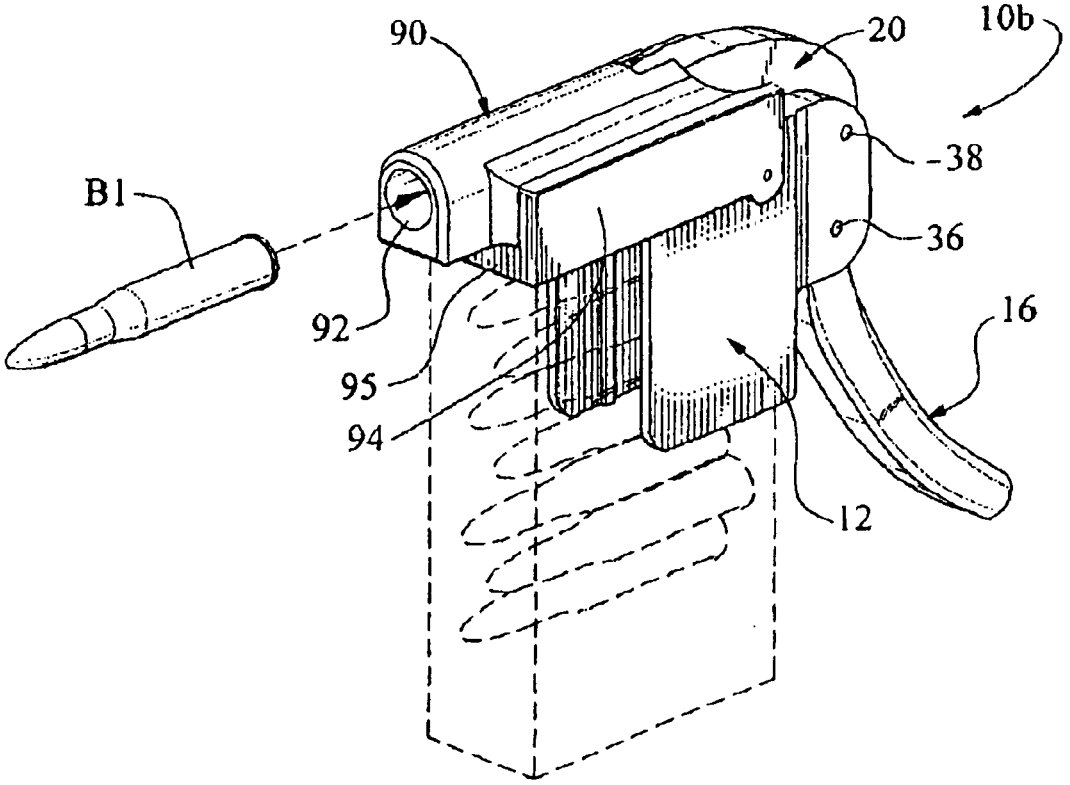
FIG. 8 is a front perspective view of the bullet loading device of FIG. 5 with an attached M-16 magazine shown in phantom.

In a preferred embodiment, the top end of the lever 16 is provided with radially projecting teeth 46 for intermeshing engagement with correspondingly positioned radially projecting teeth 44 on the cam member 20. The intermeshing teeth 46, 44 provide a positive traction between the lever 16 and the cam member 20 so that as the lever 16 is squeezed and the top end of the lever rotates about pivot pin 36, the intermeshing teeth drivingly rotate the cam member 20 about pivot pin 38. The intermeshing teeth 46, 44 are specifically structured and configured to reduce wear and friction between the moving lever 16 and moving cam member 20. A spring 50 seated within the rear of the sleeve body 12 applies an upward force against a knee 52 of the cam member 20 to urge the cam member 20 to a normally relaxed position, as seen in FIGS. 2*a*, 3*a*, 5–7*b* and 10*a*. In this position, an integral finger 60 extending from the cam member 20 is in a raised position. Upon squeezing the lever 16, with the use of one hand, towards the back wall 34 of the sleeve body 12, the top end 18 of the lever 16 rotates about the pivot pin 36, to cause driving rotation of the cam member 20 about pivot pin 38, as described above in connection with the various embodiments. Driving rotation of the cam member 20 results in driving finger 60 downwardly so that the end 62 of the finger 60 operatively engages a top bullet B aligned on the top of the magazine for loading therein. Upon continued downward movement of the finger 60 the end 62 of the finger 60 exerts a force to depress the bullet B into the magazine. In the embodiment shown in FIGS. 1–4*b*, the bullet loading device 10*a* is specifically adapted for use in conjunction with handgun magazines or clips M1. In operation, the cam lever 16 is squeezed, as indicated by the arrow in FIG. 4*a* to move the cam member 20 about the pin 38 thereby causing the end 62 of finger 60 to apply the downward force on the top bullet B within the magazine M1. This then allows a next successive bullet to be loaded within the magazine M1 to be slipped into position, as seen in FIG. 3*a*. Depending upon the particular model of the handgun and the style of the magazine M1, the bullet B may be inserted into the top of the magazine M1 or, alternatively, placed on the top of the magazine M1 and forced down into the magazine by the end 62 of the finger 60.

In the embodiment of FIGS. 1–4*b*, the bullet loading device 10*a*, which is particularly adapted for use in conjunction with handgun magazines M1, provides for the ability to adapt to all sizes, styles, makes and models of handgun magazines. In particular, a bottom support member 70 is structured and disposed to engage the bottom of the magazine M1 so that the magazine M1 is properly positioned in registered alignment within the sleeve body 12, between the side walls 30, 32 and at a proper height relative to the cam member 20 and finger 60 so that the end 62 of the finger 60 engages the top bullet B when positioned on the top of the magazine M1. The support member 70 is adjustably positionable throughout a range of heights between the side walls 30, 32 of the sleeve body 12 with the use of a knob 72 which connects to the support member 70 by a threaded rod or stem 74. As seen in FIGS. 1, 3*a* and 3*b*, the threaded rod 74 extends from the knob 72 and through a slot 76 in the rear wall 34, and into threaded engagement within the support member 70. Rotating the knob 72 in one direction serves to loosen the knob from the rear surface of the wall 34, thereby allowing the knob 72 and support member 70 to be moved upwardly or downwardly relative to the sleeve body. When the support member 70 is properly positioned, at the desired height, between the walls 30, 32 of the sleeve body, the knob 72 is tightened, by rotating, to frictionally engage the rear surface of the wall 34 of the sleeve body 12, thereby holding the support member 70 at the desired position.

The embodiment of FIGS. 1–4*b* further provides for the adaptability to varying widths or thicknesses of magazines M1. As seen throughout FIGS. 1–4*b*, a sleeve insert 80 is provided. The sleeve insert 80 is specifically structured and disposed to be received between the walls 30, 32 of the sleeve body 12 to provide a smaller transverse dimension so that the magazine M1 is held snugly within the sleeve body. Specifically, the sleeve insert 80 includes opposing walls 82, 84 which mate with the corresponding opposing walls 30, 32, respectively, of the sleeve body 12. The transverse space between the walls 82, 84 is less than the space between walls 30, 32, thereby reducing the overall transverse dimension of the sleeve body 12 for snug fitting receipt of the magazine M1 therein. It should be noted that several sleeve inserts 80 of varying size and wall thickness may be provided to accommodate a full range of magazine makes, styles, models and/or designs. To insure proper alignment and receipt of the sleeve insert 80 within the sleeve body 12, a hole 86 is formed through a top portion of the rear wall 85 of the sleeve insert 80 for receipt of a screw, peg or other member 88 on the rear wall 34 of the sleeve body 12.

Referring to FIGS. 5–8, the bullet loading device 10*b* is particularly adapted for use in conjunction with the magazine M2 of an M-16 rifle for loading bullets B1 into the magazine M2.

Figure 9A:
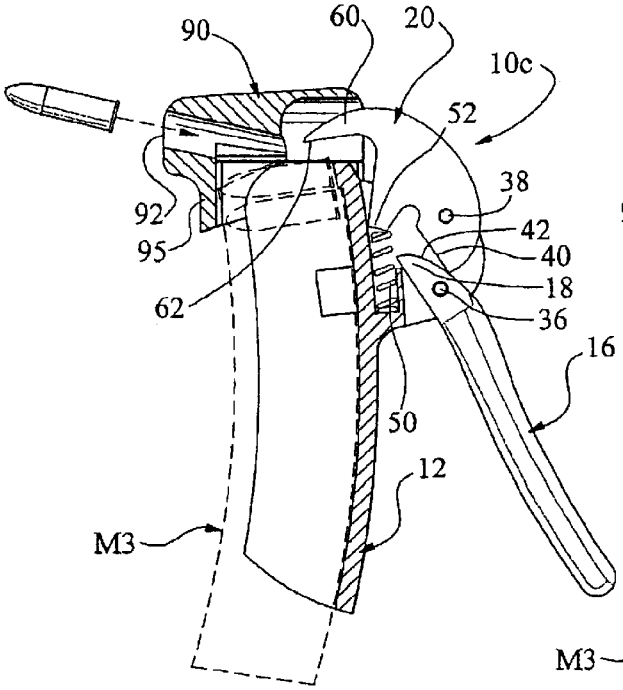
FIGS. 9*a* and 9*b* show a bullet loading device of FIGS. 9*a* and 9*b* wherein a sequence of operation of the device is shown for loading bullets into the magazine.
Figure 9B:
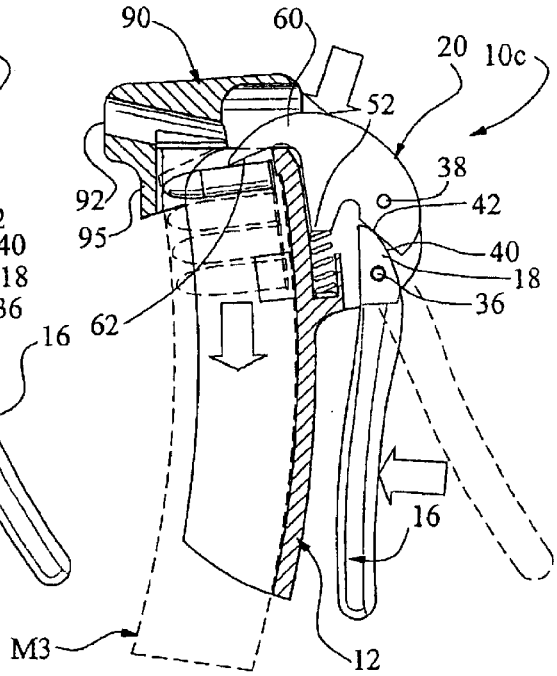
Figure 9C:
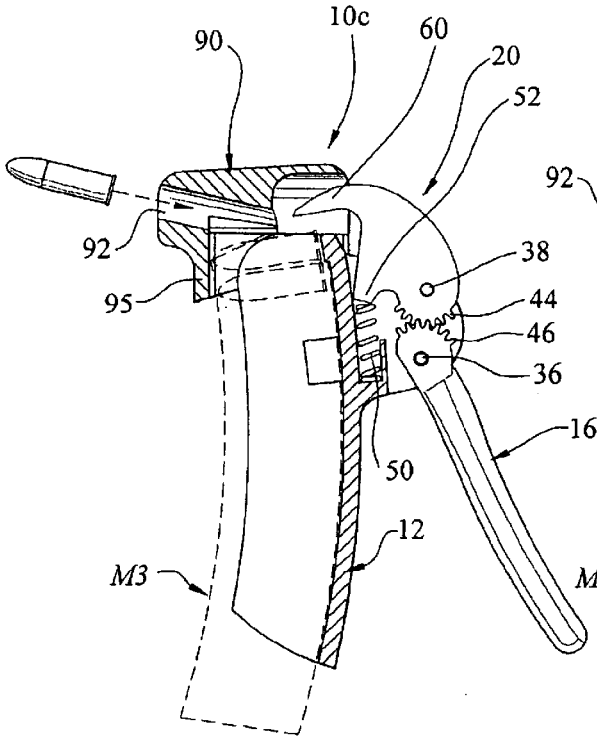
FIGS. 9*c* and 9*d* show a bullet loading device, in partial cross section, in accordance with yet another preferred embodiment of the invention for use in conjunction with an MP-5 magazine, wherein the lever and cam member are provided with intermeshing gripping teeth similar to that shown in FIG. 7*f;*
Figure 9D:
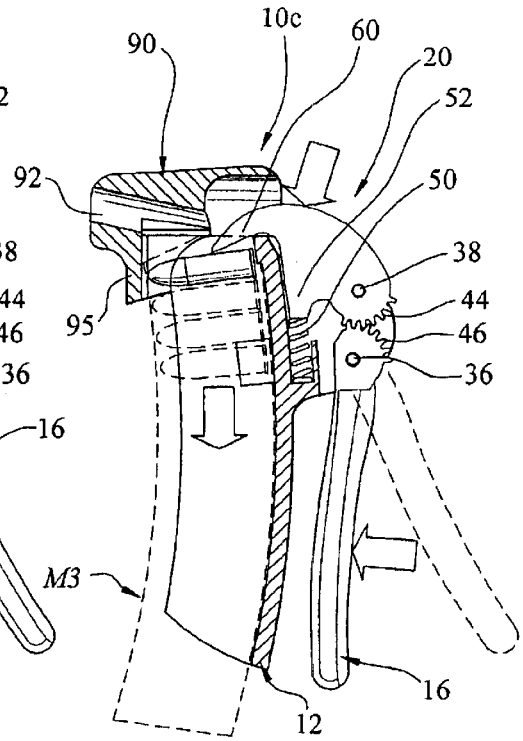

FIGS. 9*a*–9*b* illustrate yet a further embodiment of the bullet loading device 10*c* which is particularly adapted for use in conjunction with the magazine M3 of an MP-5 rifle.

Figure 10A:
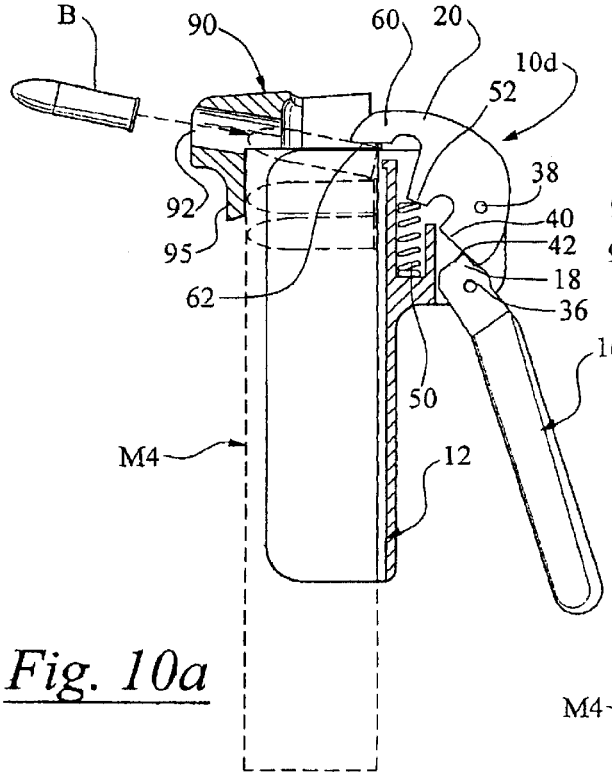
FIGS. 10*a* and 10*b* show a bullet loading device, in partial section, illustrating yet another preferred embodiment of the present invention for use in conjunction with an Uzi or AR-15 magazine, and wherein an operational sequence is shown for loading bullets into the magazine.
Figure 10B:
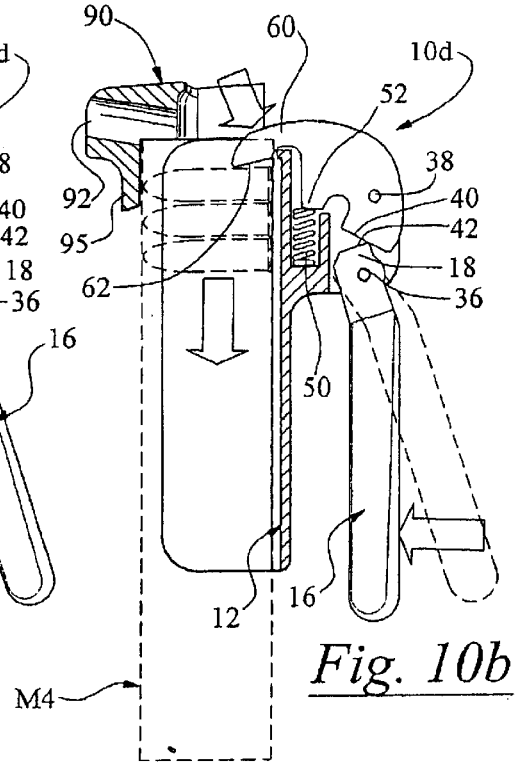
Figure 11:
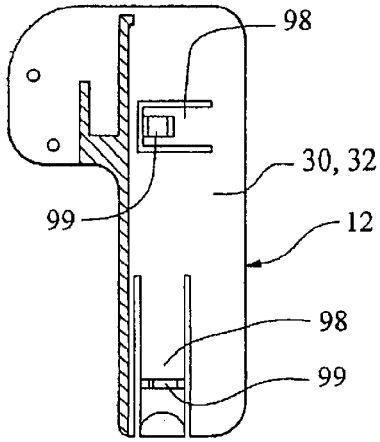
FIG. 11 is an isolated side elevational view, in partial section, illustrating an inner side wall of a sleeve of the device of FIGS. 10*a* and 10*b*, to illustrate locking tabs on the sleeve for releasably locking the sleeve onto a variety of style magazines of different manufacturers.

FIGS. 10*a*–11 illustrate yet a further embodiment of the bullet loading device 10*d* which is particularly adapted for use for loading bullets B into the magazine M4 of an Uzi or AR-15 firearm.

In each of the embodiments 10*b*–10*d*, as shown throughout FIGS. 5–11, the respective bullet loading devices operate in the same general manner as that described above. Specifically, the lever 16 is squeezed inwardly towards the rear wall 34 of the sleeve body 12, with the use of a single hand, to pivot the top end 18 of the lever 16 about pivot pin 36 resulting in driving rotation of the cam member 20 about pivot pin 38. In at least one preferred embodiment, the intermeshing gripping teeth 44, 46, on the cam member 20 and lever, respectively, provide for driving rotation of the cam member 20 upon squeezing the lever 16. In other embodiments, as described above, the top distal end 42 of the lever 16 applies a force to a cam surface 40 on the cam member 20, upon squeezing the lever 16, to drivingly rotate the cam member 20 about the pivot pin 38. It should be noted that the specific shape of the distal end 42 of the lever 16, as well as the configuration of the cam surface 40 may be varied to achieve the desired leverage action and mechanical advantage. This is largely dependent upon the particular type of magazine and the compression force of the compression spring within the magazine. Also, the throw of the finger 60 is varied according to the particular type of magazine and bullets being loaded. In referring to the various embodiments shown throughout the drawings, it will be noted that the configurations of the distal end 42 and cam surface 40 are varied, along with the throw and shape of the cam finger 60, to accommodate for the particular type of magazine and bullets being loaded, as well as to achieve the desired mechanical advantage to overcome the compression force of the compression spring within the magazine.

Each of the embodiments 10*b*–10*d*, shown throughout FIGS. 5–11, are further provided with a hood 90 pivotally fitted to a top end of the sleeve body 12. The hood 90 is structured to pivot open in order to permit placement and removal of the magazine within the sleeve body. Once the magazine is received within the sleeve body and properly positioned in registered, releasably locked alignment, the hood 90 is lowered over the top of the magazine. Preferably, the hood 90 is structured to releasably snap into place on the top of the magazine to insure proper alignment as well as to secure the device on the magazine, in proper registered position for loading operations.

In each of the embodiments, the hood 90 includes a bore 92 formed therethrough. The bore 92 is specifically sized and configured for receipt of a particular caliber bullet therethrough for registered positioning relative to the finger 60 and magazine. Specifically, the bore 92 acts as a loading chamber for guiding each bullet into proper position below the finger 60 so that when the lever 16 is squeezed and the end 62 of the finger 60 engages the bullet, the bullet is depressed down into the magazine without failure. Accordingly, the loading chamber, defined by the bore 92 of the hood 90 allows the user to easily insert bullets to be loaded into the magazine with one hand, while operating the device with the other hand. Moreover, the loading chamber of the hood 90 allows for ease of loading bullets even in poorly lit or dark conditions and without the need of actually viewing the magazine or loading device. As seen throughout the several embodiments, the hood 90 may be provided with downwardly extending side walls 94 and a front wall 95 for snug fitted, locking engagement on the top end of the magazine, thereby securing the loading device 10*b*–10*d* to the respective magazine in proper registered alignment therewith.

Referring to FIG. 11, the inner surface of either of the side walls 30, 32 of the sleeve body 12 is shown in accordance with a particular embodiment, wherein flexible tab members 98 on the side walls 30, 32 are provided with protrusions 99 for releasable, locking receipt within detents formed in the sides of the magazine to insure proper registered position and alignment of the sleeve body 12 on the magazine. The flexible tabs 98 and protrusions 99 are shown on the embodiments of FIGS. 10*a* and 10*b*. However, it is noted that this same or similar structure may be employed on the other embodiments of the bullet loading device, as shown in the previous drawing figures, for interlocking receipt with the particular type of make and model of the magazine.

While the instant invention has been shown and described in accordance with a preferred and practical embodiment thereof, it is recognized that departures from the instant disclosure are contemplated within the spirit and scope of the present invention which, therefore, should not be limited except as set forth in the following claims as interpreted under the doctrine of equivalents.

What is claimed is:

1. A device for loading bullets into a magazine of a firearm, said device comprising:

a sleeve defining a main body and being structured and disposed for receiving the magazine in seated position therein during use to load the bullets into the magazine;

a lever pivotally fitted to the main body and including a top portion with a top distal end;

a cam member pivotally fitted to said main body and disposed in operative, driven engagement with said top distal end of said lever;

a finger extending from said cam member;

a biasing element urging said cam member to a relaxed position; and said cam member, including a cam surface in operative, abutting engagement with said top distal end of said lever, and said lever being pivotally operable to cause said top distal end to drivingly engage said cam surface of said cam member, resulting in forced rotation of said cam member about a cam axis and against said biasing element so that said finger is moved towards said magazine to depress a top bullet seated in position on a top of said magazine, thereby loading said bullet into said magazine.

2. The device as recited in claim 1 further comprising:

intermeshing teeth disposed on said top distal end of said lever and said cam member, respectively, said intermeshing teeth being structured and disposed for drivingly rotating said cam member about said cam axis upon pivotal operation of said lever.

3. The device as recited in claim 1 further comprising:

a hood on a top portion of said main body and said hood including a bore extending therethrough and defining a loading chamber for insertion of the bullets therethrough and into guided, registered position on the top of the magazine for loading therein upon subsequent operation of said lever and rotation of said cam member against said biasing element.

4. The device as recited in claim 1 further comprising a sleeve insert structured and disposed to be received within said main body for accommodating variations in size of the magazine, in order to maintain the magazine in seated position within said sleeve.

5. The device as recited in claim 4 further comprising:

a magazine support member adjustably moveable within said sleeve for accommodating magazines of varying height so that the magazines are maintained in operative, seated position within the sleeve for loading the bullets therein.

6. The device as recited in claim 1 wherein said sleeve includes at least one protruding member on an inner surface thereof for releasable, interlocking receipt within a corresponding recess on the magazine, to thereby insure proper positioning of the magazine within the sleeve for loading the bullets into the magazine.

7. The device as recited in claim 6 wherein said sleeve is structured and disposed for releasable, interlocking receipt of any of a plurality of magazines of various models and sizes.

8. A device for loading bullets into a magazine of a firearm, said device comprising:

a sleeve defining a main body and being structured and disposed for receiving the magazine in seated position therein during use to load the bullets into the magazine;

an actuator member moveable about a first pivot axis and operable by a single hand of a user between a relaxed position and an actuated position;

a cam member operatively engaging said actuator member and moveable about a second axis upon operation of said actuator member between said relaxed position and said actuated position; and a finger extending from said cam member, said finger being structured and disposed to engage a top bullet seated in position on a top of said magazine and to depress said top bullet into said magazine upon operation of said actuator member about said first pivot axis from said relaxed position to said actuated position and rotation of said cam member about said second axis.

9. The device as recited in claim 8 wherein said actuator member and said cam member are operatively engaged with one another to provide a mechanical advantage which minimizes the effort necessary to operate said actuator member from said relaxed position to said actuated position and resultant movement of said cam member about said second axis to cause said finger to depress said top bullet into the magazine.

10. The device as recited in claim 9 wherein:

said actuator member is defined by a lever movable about a said first pivot axis and including a top distal end; and said cam member includes a cam surface in operative, abutting engagement with said top distal end of said lever.

11. The device as recited in claim 10 further comprising:

intermeshing teeth disposed on said top distal end of said lever and said cam member, respectively, said intermeshing teeth being structured and disposed for drivingly rotating said cam member about said second axis upon pivotal operation of said lever.

12. The device as recited in claim 10 wherein said cam member includes a cam surface in operative, abutting engagement with said top distal end of said lever, and said top distal end being structured and disposed to apply a force on said cam surface upon pivotal operation of said lever, resulting in forced rotation of said cam member about said second axis.

13. The device as recited in claim 10 wherein said mechanical advantage is variable by extending a length of said lever from said first pivot axis.

14. The device as recited in claim 10 wherein said mechanical advantage is variable by altering a configuration of said cam surface.

15. The device as recited in claim 8 further comprising:

a hood on a top portion of said main body and said hood including a bore extending therethrough and defining a loading chamber for insertion of the bullets therethrough and into guided, registered position on the top of the magazine for loading therein.

16. The device as recited in claim 15 wherein said hood is hingedly attached to said main body and operable between a raised, open position and a lowered, closed position, and wherein said closed position aligns said bore relative to the top of the magazine for guiding the bullets into registered position on the top of the magazine for loading therein.

17. The device as recited in claim 8 further comprising a sleeve insert structured and disposed to be received within said main body for accommodating variations in size of the magazine while maintaining the magazine in seated position within said sleeve.

18. The device as recited in claim 8 further comprising:

a magazine support member adjustably moveable relative to said sleeve for accommodating magazines of varying height so that the magazines are maintained in operative, seated position within the sleeve for loading the bullets therein.

19. The device as recited in claim 8 wherein said sleeve is structured and disposed for releasable, interlocking receipt of the magazine therein to insure proper registered positioning of the magazine within the sleeve for loading the bullets into the magazine.

20. A device for loading bullets into a magazine of a firearm, said device comprising:

a sleeve defining a main body and being structured and disposed for receiving the magazine in seated position therein during use to load the bullets into the magazine;

a lever pivotally fitted to the main body and moveable about a first pivot axis, said lever including a top portion with a top distal end;

a cam member pivotally fitted to said main body and moveable about a second axis, said cam member disposed in operative, driven engagement with said top distal end of said lever;

a finger extending from said cam member;

a biasing element urging said cam member to a relaxed position; and said lever being pivotally operable about said first pivot axis to drivingly engage said cam member and resulting in forced rotation of said cam member about said second axis and against said biasing element so that said finger is moved towards said magazine to depress a top bullet seated in position on top of said magazine, thereby loading said bullet into said magazine.

21. The device as recited in claim 20 further comprising:

intermeshing teeth disposed on said top distal end of said lever and said cam member, respectively, said intermeshing teeth being structured and disposed for drivingly rotating said cam member about said second axis upon pivotal operation of said lever about said first pivot axis.

22. The device as recited in claim 20 wherein said cam member includes a cam surface in operative, abutting engagement with said top distal end of said lever, and said top distal end being structured and disposed to apply a force on said cam surface upon pivotal operation of said lever about said first pivot axis, resulting in forced rotation of said cam member about said second axis.

23. The device as recited in claim 20 further comprising:

a hood on a top portion of said main body and said hood including a bore extending therethrough and defining a loading chamber for insertion of the bullets therethrough and into guided, registered position on the top of the magazine for loading therein upon subsequent operation of said lever and rotation of said cam member against said biasing element.

24. The device as recited in claim 20 further comprising a sleeve insert structured and disposed to be received within said main body for accommodating variations in size of the magazine, in order to maintain the magazine in seated position within said sleeve.

25. The device as recited in claim 24 further comprising:

a magazine support member adjustably moveable within said sleeve for accommodating magazines of varying height so that the magazines are maintained in operative, seated position within the sleeve for loading the bullets therein.

26. The device as recited in claim 20 wherein said sleeve includes at least one protruding member on an inner surface thereof for releasable, interlocking receipt within a corresponding recess on the magazine, to thereby insure proper positioning of the magazine within the sleeve for loading the bullets into the magazine.

27. The device as recited in claim 26 wherein said sleeve is structured and disposed for releasable, interlocking receipt of any of a plurality of magazines of various models and sizes.

* * * * *